United States Patent [19]

Maroney

[11] 4,218,608

[45] Aug. 19, 1980

[54] MULTIPLE DUCT BLOW DRYER AND HAIR STYLER

[76] Inventor: Michael V. Maroney, P.O. Box 4748, Medford, Oreg. 97501

[21] Appl. No.: 931,466

[22] Filed: Aug. 7, 1978

[51] Int. Cl.[2] ..... A45D 20/12; B05B 1/12; F24H 3/04

[52] U.S. Cl. ..... 219/368; 34/97; 34/243 R; 132/9; 219/370; 219/373

[58] Field of Search ..... 219/368-371, 219/373-382; 34/96-98; 132/9, 11 R

[56] References Cited

U.S. PATENT DOCUMENTS

| | | | |
|---|---|---|---|
| 1,998,159 | 4/1935 | Johnson et al. | 34/98 |
| 2,022,237 | 11/1935 | Grant | 34/98 |
| 2,090,165 | 8/1937 | Werner | 34/98 |
| 3,272,966 | 9/1966 | Sutton | 219/370 |
| 3,612,824 | 10/1971 | Berryman et al. | 34/97 |
| 3,674,980 | 7/1972 | Cox | 34/97 |
| 4,097,722 | 6/1978 | Soler et al. | 219/368 |

FOREIGN PATENT DOCUMENTS

| | | | |
|---|---|---|---|
| 1273028 | 5/1972 | United Kingdom | 219/368 |

*Primary Examiner*—B. A. Reynolds
*Assistant Examiner*—Bernard Roskoski
*Attorney, Agent, or Firm*—James D. Givnan, Jr.

[57] ABSTRACT

A blow dryer having a partitioned barrel providing an air duct for the flow of heated air and a duct for the flow of ambient temperature air. A baffle at the upstream end of the barrel controls the fan discharged air while a second baffle is positionable to divert an element cooling airflow from being exhausted against the person's head.

3 Claims, 5 Drawing Figures

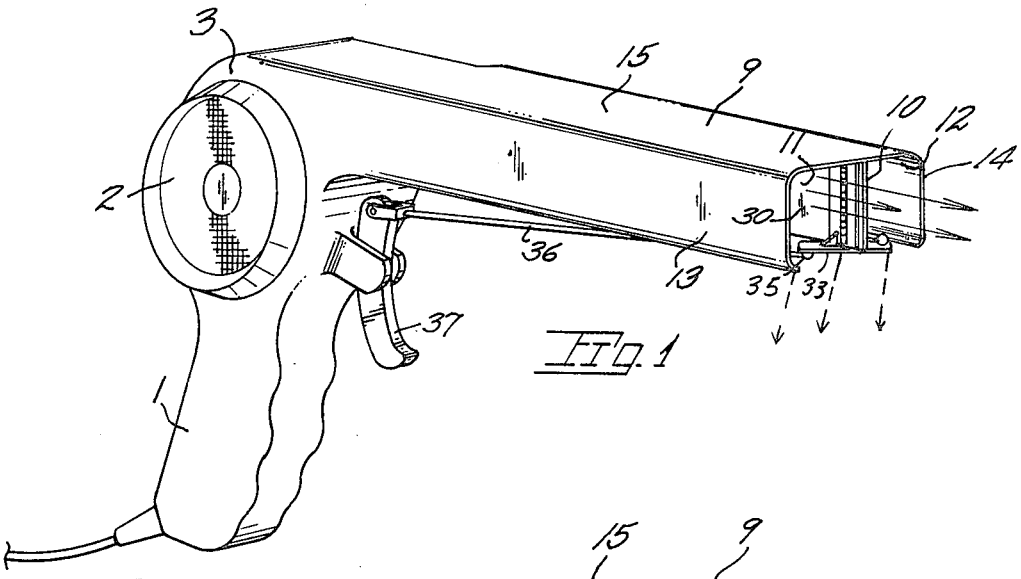
FIG. 1
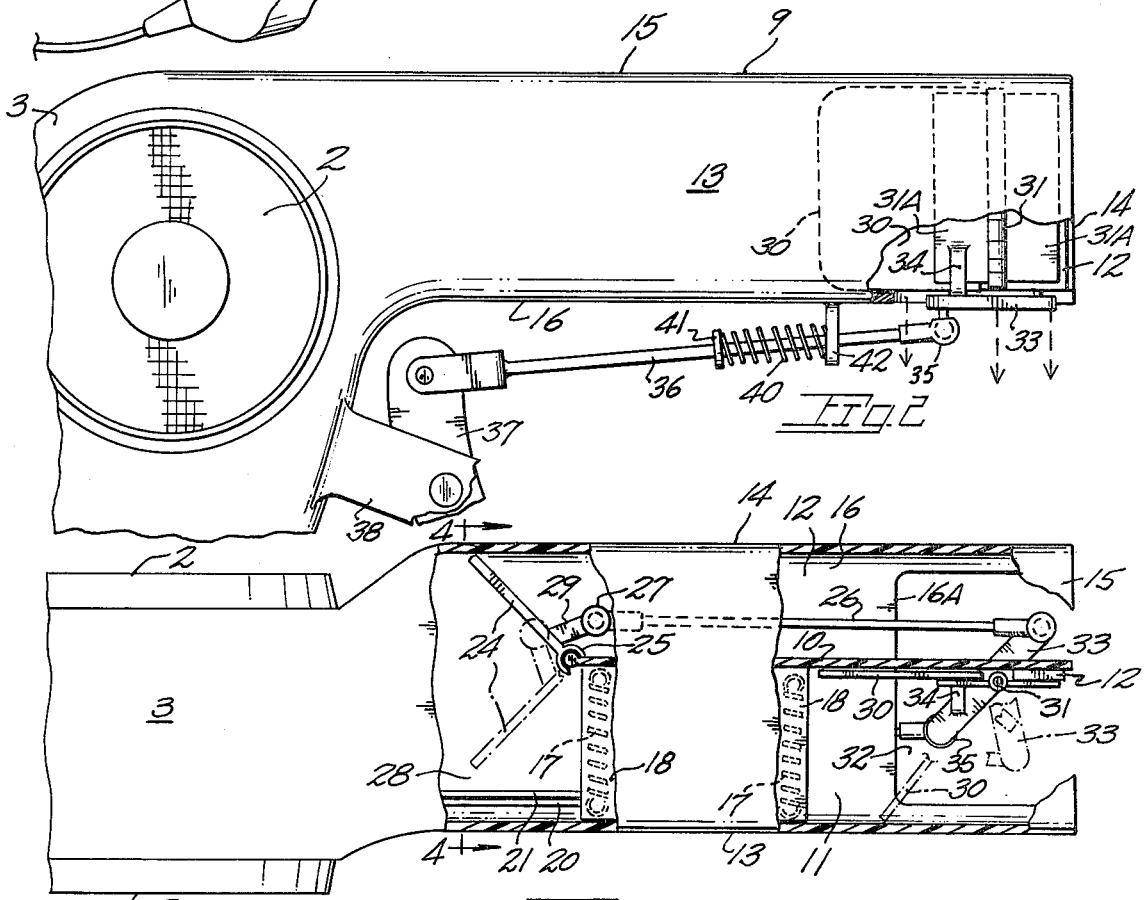
FIG. 2
FIG. 3
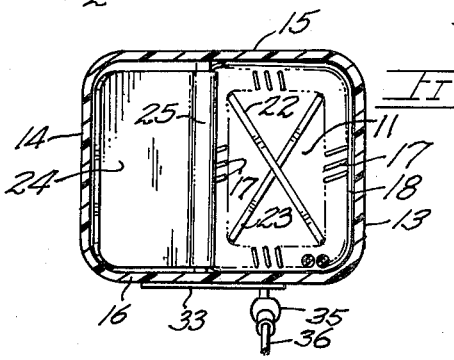
FIG. 4
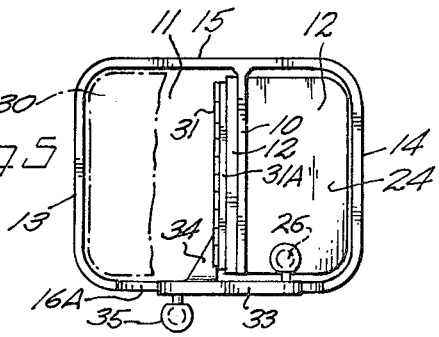
FIG. 5

MULTIPLE DUCT BLOW DRYER AND HAIR STYLER

BACKGROUND OF THE PRESENT INVENTION

The present invention pertains generally to hair dryers and particularly hand held dryers termed blow dryers by the public.

In wide use presently are hand held blow dryers having a fan and motor assembly for driving a flow of air past a heat source. Conventionally, such devices broadly resemble a pistol in that they include a handgrip and a barrel portion. Finger operated switch controls are mounted on the handgrip and are in circuit with the electric motor and with an electrical heating element to provide selective operation of the fan and motor with or without energization of the heating element. Further, some hair dryers include a provision for varying the temperature of the airflow discharge by regulating current flow to the heating element.

For the drying of hair, such devices are generally satisfactory, but are somewhat deficient from a styling standpoint as follows. A strand of hair includes a cuticle layer which, when subjected to above normal temperatures, is displaced outwardly from the hair shaft rendering the hair largely unmanageable by reason of the presence of static electricity. Further, a hair shaft in such a condition does not retain a curve or style imparted to it.

Accordingly it has been found beneficial to subject the hair to a flow of air at room temperature at the latter stage of drying to contract the cuticle layer and hence reduce static electricity to enhance retention of a styled shape.

In the styling of hair with conventional blow dryers a delay is incurred as the stylist must wait for the exhaust flow to dissipate heat from the de-energized heating coils before he can apply a flow of ambient or cool air to the hair. In a hair styling salon during the course of a busy day considerable time on a cumulative basis is lost which could otherwise be put to profitable use by each stylist serving one or two additional patrons during the work day.

SUMMARY OF THE PRESENT INVENTION

The present invention is embodied within a blow dryer which may selectively provide instantaneous flows of heated air or ambient air at the demand of the operator.

The present blow dryer is advantageously used though not restrictively by professional hair stylists who serve a succession of patrons where the time required for each patron has a distinct impact on shop income. By utilizing multiple ducts within the present blow dryer, the operator may instantaneously vary the temperature of the blow dryer discharge flow. A heated discharge flow is used for drying of the hair to a desired point whereafter the hair is styled with remaining drying accomplished with an ambient temperature flow of air. This last step serves to contract the cuticle layer about the hair shaft and contribute to style retention.

A provision of the present blow dryer prevents the overheating of the blow dryer barrel by routing or bleeding of a cooling portion of the fan discharge past the heat source.

Important objectives of the present blow dryer is the provision of a blow dryer providing the hair stylist with a selected instantaneous flow of either heated or unheated air to avoid time lost heretofore in waiting for the cooling of the blow dryer heat source; the provision of a blow dryer particularly suited for hair styling in that an instantaneous flow of cool air is available to the stylist for imparting a set to styled hair, and; the provision of a blow dryer having a finger operated control enabling convenient selection of heated or ambient air or a mixture thereof.

BRIEF DESCRIPTION OF THE DRAWING

In the accompanying drawing;

FIG. 1 is a perspective view of the present blow dryer;

FIG. 2 is a side elevational view of the barrel and fan housing of the present blow dryer;

FIG. 3 is a plan view of FIG. 2 with fragments of the blow dryer barrel structure broken away for purposes of illustration;

FIG. 4 is a vertical sectional view of the barrel taken along line 4—4 of FIG. 3; and FIG. 5 is an end view of the barrel from the right hand side of FIG. 3.

DETAILED DESCRIPTION OF THE PREFERRED EMBODIMENT

With continuing attention to the drawing disclosing present blow dryer, the same includes a handgrip portion 1 which conventionally houses multiple electric switches (not shown) in circuit with a fan motor and with an electrical resistance heater of the blow dryer. Air intakes 2 permit entry of room (ambient) air to a fan and motor assembly within a dryer housing at 3. The foregoing generally describes conventional blow dryer structure as found in various makes of blow dryers.

The present blow dryer includes a novel barrel portion 9 which enables the instantaneous discharge of heated or ambient temperature air. A partition 10 extends lengthwise of the dryer barrel which is laterally defined by side walls 13 and 14. A top wall at 15 extends the length of the barrel while a bottom wall 16 is truncated at 16A to provide a vent area as later set forth. The foregoing wall structure of the barrel defines a hot air duct 11 and an ambient air duct 12 the latter herein termed a cold air duct.

Disposed within duct 11 are electrical resistance heater coils 17 suitably insulated from internal barrel surfaces by an insulative sleeve 18 of asbestos or the like. Leads at 20 and 21 are in circuit with coils 17 and with a switch control located on the unseen side of handgrip 1. Coil retainer plates are indicated at 22 and 23.

Baffle means are provided for directing the fan discharged airflow to provide a heated or cold (ambient) airflow discharge from the outer end of barrel 9. A baffle at 24 is located in the upstream end of barrel 9 and in one position (shown in full lines in FIG. 3) closes cold air duct 12 so as to divert the fan output toward heated air duct 11. Said baffle is in hinged connection at 25 with the upstream end of partition 10 with baffle movement being in response to a link 26 pivotally attached at 27 to an ear 29 on said baffle. In a second or broken line position, baffle 24 partially obstructs fan discharge to divert same into cold air duct 12. Said second position also permits a continuous portion of the fan discharge to be bled off via a space 28 for passage through heated air duct 11 to cool heater coils 17 thereby preventing heat damage to barrel structure. As later explained, this cooling flow of air is directed in a non-linear fashion to avoid contact with the person's hair.

A second baffle at 30 is carried by a hinge 31 suitably affixed to partition 10 by means of hinge plates 31A and spacer 12. Baffle 30 is of a size to close the downstream end of heated air duct 11 to cause, when in the duct closing position, a downwardly diversion of air through a vent area 32 past a wall member of the barrel. A toggle at 33 is carried by baffle 30 and with same moves about hinge 31 and pivotally carries at one of its ends the remaining end of link 26 for synchronized baffle movement. A gusset at 34 reinforces the toggle attachment to hinge 31. The remaining end of toggle 33 receives, in a pivoted manner at 35, an actuating rod 36 of baffle control means which further includes a trigger 37 disposed in a bracket 38 for convenient finger manipulation. To bias trigger 37 and the baffles to the full line position shown, a spring component 40 acts on a stop 41 on rod 36 with the remaining spring end supported by a barrel projection 42.

With the baffles in the full line positions shown, the fan discharge is routed through hot air duct 11 to accomplish rapid drying of the hair. Before drying is complete, the hair is styled whereafter any remaining drying is accomplished by air exhausted through the cold air duct 12 with the baffles 24 and 30 moved to their broken line positions. The fan discharge bled off for cooling heater coils 17 is discharged via vent area 32 away from the person's head.

While I have shown and described but one embodiment of the invention it will be apparent to those skilled in the art that the invention may be embodied still otherwise without departing from the spirit and scope of the invention.

Having thus described the invention, what is desired to be secured under a Letters Patent is:

1. In a hand held blow dryer having a fan and motor assembly, a housing defining an air intake, a handgrip portion, switch controls for said fan and motor assembly and for a resistance type electrical heater, the improvement comprising, blow dryer barrel structure including barrel walls and a partition defining a hot air duct having said heater therein and a cold air duct, one of said barrel walls defining a vent opening, a first baffle swingably supported by said barrel structure upstream of said partition, said baffle in a first position closing said cold air duct, said baffle having a second position opening said cold air duct and partially closing said hot air duct to enable bleeding off of a fan discharged airflow to assure cooling of the barrel structure at all times, a second baffle supported by said barrel structure and located adjacent the discharge end of said hot air duct and adjacent said vent opening and operable to partially close the hot air duct to divert the barrel cooling airflow through the barrel wall defined vent opening and away from the person's head, linkage coupling the first and second baffles for synchronized movement of same such that said second baffle partially closes said hot air duct when said first baffle is in said second position, and finger actuated baffle control means coupled to one of said baffles enabling the operator to manually control baffle position and thereby determine the temperature of the airflow discharged from the barrel structure.

2. The improvement claimed in claim 1 wherein said first and second baffles are swingably supported by said partition.

3. The improvement claimed in claim 2 wherein said linkage is disposed within said barrel structure.

* * * * *